US006408444B1

(12) United States Patent
Zinna

(10) Patent No.: US 6,408,444 B1
(45) Date of Patent: Jun. 25, 2002

(54) RACE NUMBER BELT WITH SNAP RACE IDENTIFICATION NUMBER ATTACHMENT SYSTEM

(75) Inventor: Leonard C. Zinna, 1651 So. Juniper St. #20, Escondido, CA (US) 92025

(73) Assignee: Leonard C. Zinna, Escondido, CA (US)

( * ) Notice: Subject to any disclaimer, the term of this patent is extended or adjusted under 35 U.S.C. 154(b) by 0 days.

(21) Appl. No.: 09/808,909

(22) Filed: Mar. 14, 2001

Related U.S. Application Data

(60) Provisional application No. 60/189,275, filed on Mar. 14, 2000.

(51) Int. Cl.[7] ..... A41F 9/00

(52) U.S. Cl. ..... 2/312; 2/315

(58) Field of Search ..... 2/338, 311–319, 2/321–322; 40/640, 586; 24/662, 682.1, 104, 31 R

(56) References Cited

U.S. PATENT DOCUMENTS 1,525,464 A * 2/1925 Parke ..... 2/319
4,651,989 A * 3/1987 Wilson ..... 2/321
4,735,753 A * 4/1988 Ackermann ..... 24/104
5,175,911 A * 1/1993 Terrels et al. ..... 24/674
5,299,324 A * 4/1994 Zinna ..... 2/312

* cited by examiner

*Primary Examiner*—John J. Calvert
*Assistant Examiner*—Tejash D Patel

(57) ABSTRACT

An elastic (1) belt with a buckle (2) and having an adjustment slide (3) for waist size adjustment and snap race identification number attachment System" to secure the identification number to the elastic (1). Which consists of 2 snap caps 4A and 4B and two snap sockets 8A and 8B that are spaced as to accept a variety of different size race identification numbers. And two mating snap studs 5A and 5B. The number is held in place by peeling off the two center mating snap studs 5A and 5B, placing the identification number in the desired position over the two center snap sockets 8A and 8B, make an imprint of the snap sockets 8A and 8B on the number material with your thumb and by pressing down to replace the two mating snap studs 5A and 5B.

1 Claim, 1 Drawing Sheet

"RACE NUMBER BELT" WITH
SNAP RACE IDENTIFICATION NUMBER ATTACHMENT SYSTEM

INVENTOR
LEONARD C. ZINNA

RACE NUMBER BELT WITH SNAP RACE IDENTIFICATION NUMBER ATTACHMENT SYSTEM

I Leonard C. Zinna claim Provisional patent application No. 60/189,275 filed on Mar. 14, 2000.

BACKGROUND FIELD OF INVENTION

This invention relates to a system used on a belt to attach a race identification number used by athletes in competition or anywhere a race identification number is required.

BACKGROUND—DESCRIPTION OF PRIOR ART

During athletic events athletes are often required to wear a number to positively be identified. Race organizers supply these numbers to contestants in an athletic event. Some examples of athletic events are Triathlons, Duathlons, Running or Bicycle races. But not confined to these.

These race identification numbers are commonly made from paper approx 8 inches by 6 inches with one hole in each corner but can vary in size and are attached using safety pins often supplied by the race organizer.

The competitors find the use of safety pins very cumbersome and they do not like the idea of having to put pinholes through their clothing, which is often expensive. Pins start holes in material and if left in after an athletic event combined with perspiration can cause rust stains on the garment. Also a major draw back of using pins is when the event is a multi-sports event such as a Triathlon. Which is a sport were the contestant must swim, bicycle and then run and must be wearing a race identification number when they cross the finish line.

Since it is not practical to swim with an identification number attached to your swimsuit or wet suit, athletes would use makeshift belts using underwear elastic rubber bands and would pin the race identification number to the makeshift belt. These belts often were cumbersome to put on in a race when time is of the essence. When the contestant would try to put on the belt over their heads or step into it inadvertently the race number would be twisted around the belt. Some athletes would make their own belts using elastic and hook and loop fasteners and since the number was attached in the middle of the belt the hook and loop fasteners would have to be closed in back so as to allow the race number to be in front. And often when trying to close the hook and loop fasteners the hook and loop fasteners would be crossed and would not hold, as well as when the hook and loop fasteners would get saturated with perspiration or drinking water. And often this would have to be done while running. Besides the fact that these belts would not work very well there was no way to attach the race identification number without the cumbersome use of pins. It also was not adjustable so it would not be able to fit a variety of waist sizes as well as often not being very aesthetically appealing. In prior patent 5,299,324 an athlete when wearing this belt under their wetsuit would often rip off the cord locks when trying to take off their wetsuit in transition. In addition when using this kind of belt the number would be attached using the two top holes in the number, the number would be worn to low around the athlete's waist and would interfere with the movement of their leg while running.

OBJECTS AND ADVANTAGES

Several objects and advantages of my invention are:

(a) To provide a quick method of attaching a race identification number without the use of pins.

(b) To provide a belt which is quick and easy to put on while on the run.

(c) To provide a comfortable belt that can be worn against the skin.

(d) To provide a belt that is adjustable and able to fit a variety of waist sizes.

(e) To provide an identification number attachment system that can accommodate a variety of different size race identification numbers.

(f) To provide a belt that can be custom printed and can be used as a promotional item.

(g) To provide a belt in a variety of colors.

(h) To provide a belt that an identification number can be attached any place on the identification number, without the use of the holes in the identification number.

Further objects and advantages of my invention will become apparent from a consideration of the drawing and ensuing description.

DRAWING FIGURES

REFERENCE NUMERALS IN DRAWINGS

Figures 1, 2, 3, 4, 5, 8:
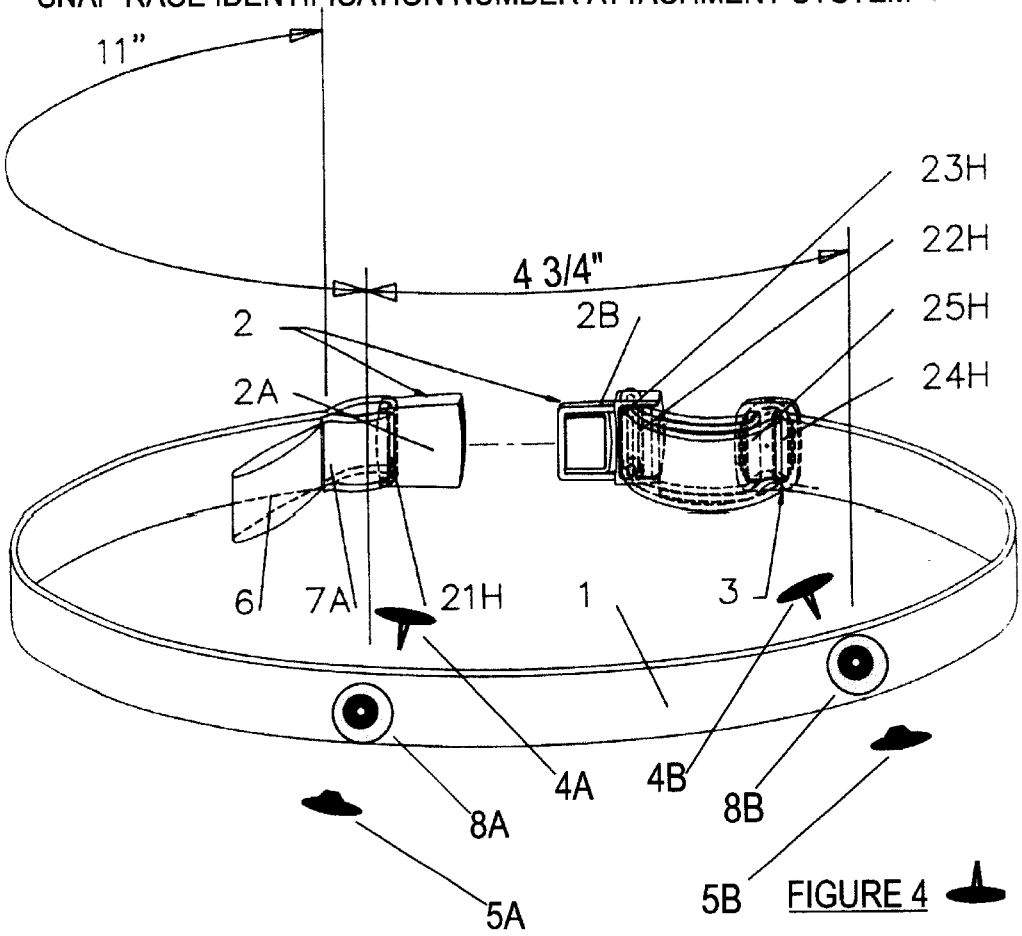
FIG. 1 is a perspective inside view of the buckle and elastic belt threading technique and outside view of the "Race Number Belt" and snap race identification number attachment System
FIG. 2 is an inside view of the buckle (LOW PROFILE CENTER RELEASE BUCKLE)
FIG. 3 is an inside view of the adjustment slide (LOW PROFILE TRIGLIDE)
FIG. 4 is a side view or the snap cap
FIG. 5 is a side view of the mating snap stud
FIG. 8 is a inside view of the snap socket looking through the hole

1 inch by 37-½ inch woven elastic
2 Buckle (LOW PROFILE CENTER RELEASE BUCKLE)
2A Female part of buckle 2
2B Male part of buckle 2
3 Adjustment slide (LOW PROFILE TRIGLIDE)
4A and 4B Snap caps
5A and 5B Mating snap studs
6 Label
7A Stitch
8A and 8B Snap sockets
21H–25H Openings

Description—FIG.1

A typical embodiment of this invention is illustrated in FIG. 1. The belt is made of one inch woven elastic 1 and is 37 ½ inches in length that is cut from a roll of 36 yards with a hot knife so as to burn both ends of the elastic, so it can not unravel. The elastic 1 can be purchased from South Carolina Elastic of Landrum, S.C. The belt is fastened using a buckle (CENTER RELEASE BUCKLE) 2 that has both a male 2A and female 2B portion and is available from ITW Nexus of Wood Dale, Ill. The elastic 1 is threaded from the outside and down opening 21H in the female buckle 2B and folded over approximately 1 inch. A label 6 is placed between the folded elastic, a stitch is applied to secure the buckle at 7A. This attaches the female (receptor) end 2B of the buckle to the elastic 1. The male end of the belt 2A and adjustment slide (ELASTIC ADJUSTMENT SLIDE) 4 are threaded opposite the female end 2B. To do this thread the elastic 1 from the inside of the adjustment slide (ELASTIC ADJUSTMENT SLIDE) 4 up through opening 22H and down through opening 23H in the adjustment slide (ELASTIC ADJUSTMENT SLIDE) 4 continue from the inside of male 2A up through opening 24H and down through opening 25H. Continue up through opening 22H in adjustment slide (ELASTIC ADJUSTMENT SLIDE) 4 and down opening 23H. The adjustment slide (ELASTIC ADJUSTMENT SLIDE) 4 and male 2A is secured. Snap caps 4A and 4B and snap sockets 8A and 8B, which can be purchased from (YKK CORP. OF AMERICA) needs to be attached to the elastic 1. Caps 4A and 4B is applied to the backside of the elastic 1 while the snap socket 8A and 8B is applied to the front of elastic 1 with the use of a snap tool. Measuring 11 inches from center of stitch 7A, and up or down ½ inch on the elastic 1 apply one snap cap 4A to the backside of elastic 1 with one snap socket SA to the front side of elastic 1. Measuring 4¾ inches further and up or down ½ inch on the elastic apply another snap cap 4B to the backside of elastic 1. With another snap socket 8B to the front side of elastic 1. To be able to secure a race identification number to the belt, two mating snaps need to be used. A mating snap consists one snap stud. And are mated to the two snap sockets 8A and 8B on the front of the belt.

Operation—FIG. 1

To use the "Race Number Belt" with snap on race identification number attachment System". One must first put the Race Number Belt" around the waist. Insert the male end 2B of the buckle (SIDE RELEASE BUCKLE) 2 into the female end 2A (A click will be heard when the buckle is successfully, engaged). The buckle 2 can either be engaged in front of the body and with one hand spun around so the number is in front of the body or the buckle can be engaged in back of the body. (Number can be worn front or back) If the belt is to tight or loose the elastic 1 can be adjusted using the adjustment slide (LOW PROFILE TRIGLIDE) 3. To make belt tighter continue to thread elastic 1 further through adjustment slide (LOW PROFILE TRIGLIDE) 3 and male 2B while sliding adjustment slide (LOW PROFILE TRIGLIDE) 3 down elastic 1 away from male 2B. To loosen belt slide adjustment slide (LOW PROFILE TRIGLIDE) 3 up elastic 1 toward male 2B while lengthening elastic 1.

Now that the "Race Number Belt" is comfortably adjusted around the waist, the race identification number can be attached to the belt. The following steps are required to attach a race identification number to the belt.

First the belt must be taken off and placed face up on a hard surface such as a table. Peel off the two center mating snap studs 5A and 5B, place the identification number in the desired position over the two center snap sockets 8A and 8B, make an imprint of the snaps sockets 8A and 8B on the number material with your thumb, press down on the mating snap stud 5A with thumb crushing the identification number between the mating snap stud 5A and the snap socket 8A till a click is heard. Repeat process with snap socket 8B and 5B. The identification number is now secured to the belt.

The "Race Number Belt" is now ready for use.

Summary, Ramifications, and Scope

Accordingly, the reader will see that the "Race Number Belt" with snap on race identification number attachment System" in this invention can be used quickly and easily to attach a race identification number without the use of pins. And can be utilized in a quick manner (on the run) when time is of the essence. As well as supplying a very attractive accessory. Further more the "Race Number Belt" with snap on race identification number attachment System" has the additional advantages in that:

- No longer does the athlete have to restrict the attachment of their identification number by using the holes in the number.
- Provide a belt that allows the attachment of an identification number to be raised and worn above the belt no longer interfering with the athlete's leg movement.
- It provides a belt that can be comfortably worn in athletic competition;
- It permits two adjustments one for waist size (one size fits all) and the other for the variation in race identification number size;
- It also provides an elastic surface that can be printed on with various promotions;
- It also can be provided in an assortment of colors;

Although the description above contains much specificity, these should not be construed as limiting the scope of the invention but as merely providing illustrations of some of the presently preferred embodiments of this invention. For example, substitution of the materials in the make up of this belt can be used with some degree of success. The snap "race identification number attachment system" can be applied to other forms of clothing such as shirts, singlets and shorts Etc.

Thus the scope of the invention should be determined by the appended claims and their legal equivalents, rather than by the examples given.

I claim:

1. An elastic belt for attachment around a waist of a wearer comprised of an elongated elastic strip having two ends and a central portion wherein a male buckle component is attached at one end and a female buckle component is attached at the other end for attachment to said male buckle component a length adjustment slide device on said elastic belt for waist size adjustment and a race identification number attachment means attached to said central portion of said elastic belt and consisting of two sockets that are attached to said elastic belt using caps applied to a backside of said elastic belt while said sockets are applied to a front side of said elastic belt and are spaced as to accept various size identification signs placing identification number sign between said sockets and mating studs to said sockets while crushing said identification sign material between mated said sockets and studs, by allowing said identification number sign to be securely but not permanently attached to said elastic belt.

* * * * *